United States Patent [19]

Sancaktar

[11] Patent Number: 4,910,059

[45] Date of Patent: Mar. 20, 1990

[54] TAPERED ROOFING MEMBRANE

[75] Inventor: Erol Sancaktar, Potsdam, N.Y.

[73] Assignee: The Kendall Company, Boston, Mass.

[21] Appl. No.: 892,679

[22] Filed: Aug. 1, 1986

[51] Int. Cl.[4] ..... B32B 3/14

[52] U.S. Cl. ..... 428/47; 428/60; 428/61; 428/192

[58] Field of Search ..... 428/57, 60, 194, 47, 428/61, 192; 156/157, 304.1, 304.5

[56] References Cited

U.S. PATENT DOCUMENTS 4,379,114 4/1983 Fujiki et al. ..... 156/157

FOREIGN PATENT DOCUMENTS 922746 4/1963 United Kingdom ..... 428/60

*Primary Examiner*—Pamela R. Schwartz

*Attorney, Agent, or Firm*—Alvin Isaacs

[57] ABSTRACT

Novel roof membranes for providing improved lap joints with adjacent roof membranes, wherein opposed edges of the adjacent membranes for the lap joint are tapered.

10 Claims, 4 Drawing Sheets

TAPERED ROOFING MEMBRANE

BACKGROUND OF THE INVENTION

Various roof membranes are well-known in the art, the most commonly used being so-called single ply materials. In general, these single ply materials may be separated into four classes: modified bitumens; thermoplastics; elastomerics; and uncured elastomers. The modified bitumen group includes various membranes having an asphalt or coal tar content in them. They may also contain polymer additives or modifiers as well as various types of reinforcement (either within the membrane or its surface). The thermoplastic-type membranes are primarily polyvinyl chloride (PVC) or any sheet which has PVC as a principal polymer. They also include other thermoplastic polymers alloyed with PVC. The elastomers are predominantly ethylene propylene diene monomer (EPDM) with neoprene following in the order of usage. The materials are essentially thermosets or cured (or vulcanized) membranes which cannot be welded together. They can only be spliced with contact or tape adhesives. The uncured elastomers are materials which come to the roof in a thermoplastic state and can be solvent or heat welded for lap joint construction. They slowly cure or cross-link due to the sun's radiation and become elastomers in place, on the roof.

Since these general classes of roofing membranes are well-known and per se comprise no part of this invention, they need not be described in greater detail.

Generally, roof membranes can be used in four different types of roof system assemblies: loose laid/ballasted; partially adhered (or mechanically attached); fully adhered; and the protected roof membrane assembly.

Irrespective of the means of installation, where the membrane is of insufficient size to cover the roof, it will be appreciated that two or more membranes must be employed. For optimum protection against moisture and/or other environmental conditions, these multiple membranes should be seamed together. While the membranes could be butted together along adjacent edges and then sealed, the most efficacious way is to provide a lap joint wherein one edge of a membrane covers or overlaps the adjacent edge of another membrane.

The present invention relates to improved construction of a roof membrane, e.g. a previously known membrane, to provide a superior lap joint between two adjacent membranes. Since, as mentioned earlier, EPDM and other elastomers can only be seamed or spliced with contact or tape adhesives, the invention is particularly directed to roofing membranes of this description and will accordingly be discussed hereinafter for purposes of illustration by reference thereto. In recent years, EPDM has become very popular as a roof membrane. According to the "1984 Handbook of Single-Ply Roofing Systems", published by Harcourt Brace Jovanovich Publications, there were nineteen (19) different manufacturers offering fifty-one (51) different EPDM membranes.

By way of illustration, mention may be made of the "POLYKEN" (trademark of The Kendall Company) Roofing Systems utilizing a black EPDM 45 mils thick, having a weight/sq. ft. of 0.28 lb, and commercially available in 7, 10, 20, 30, 40 and 100 foot widths. Irrespective of the system of installation and the insulation or other substrate on which it is laid, adjacent sheets should be lap joined, e.g. with a tape which of course should be two-faced.

Pressure-sensitive adhesives of known formulation are particularly suitable for this purpose, an especially useful one being a butyl rubber-based adhesive. The tape may comprise a suitable support sheet having an adhesive layer on each surface or it may comprise a single adhesive layer of of appropriate thickness, e.g. on the order of 40 mils. Preferably, a release sheet is provided on at least one surface so that the tape may be provided in roll form.

If found desirable to do so, the periphery of the membrane may be provided with a primer coat to increase cohesion with the particular tape employed. However, when employing rubber-rubber bonds, that is, when a butyl rubber or other rubber-based tape is employed with an EPDM membrane, such primer coatings have not been found to be necessary.

An EPDM membrane of the foregoing description may be installed by any of the aforementioned systems, namely, loose-laid/ballast, partial attachment, fully adhered, or by protective membrane roofing assembly, as desired. It may be employed for re-roofing or as a new roofing over various insulation materials including perlite, urethane, wood fiber, fiberglass, expanded polystyrene, composite boards, cellular glass, extruded polystyrene, and the like.

Regardless of the method of installation, if a single sheet is not sufficient to cover the roof, a lap joint will be made with one or more adjacent sheets. If two or more sheets of sufficient length are to be laid side by side, one lateral edge of one sheet will overlap the adjacent lateral edge of the next adjacent sheet. In like manner, if two (or more) sheets are to be laid end to end, the end portions of adjacent sheets will provide a lap joint, e.g. laying the trailing end portion of one sheet over the leading end portion of the next adjacent sheet. In any event, the lap joint will typically be on the order of at least three inches.

Following the laying of the membranes in the foregoing manner, the overlapping portion is then peeled back, a roll of the two-sided pressure-sensitive tape (typically with a release sheet on one side) is then adhered to the exposed surface of the underlying sheet edge, after which the release sheet is removed from the free surface of the tape and the top sheet is then repositioned so that the top (free) surface of the tape is adhered to the underside of the overlapping sheet, thereby completing the lap joint.

While in theory, the lap joint seal should be entirely satisfactory over a prescribed time period and under the expected or usual environmental conditions, it has been found that this is not always the case.

Specifically, it has been found that, following installation of the roofing system, environmental forces such as temperature changes and wind drag cause certain degradative changes in the lap joint.

These degradative changes are manifested as random separations or puckering along the lap joint which may be termed "fish-mouth" resulting from Poisson's effect. These fish-mouth separations permit moisture to enter, which in turn will cause rotting and/or other adverse effects on the underlying roof material.

The present invention is directed to the task of materially reducing if not obviating the fish-mouth problem so as to increase substantially the longevity of the lap joint seal and thus materially increase the time period between installation and repair of the lap joint.

BRIEF DESCRIPTION OF THE INVENTION

In accordance with the present invention, the aforementioned task is solved if opposed edges of the lap joint membranes are tapered.

DETAILED DESCRIPTION OF THE INVENTION

As mentioned, the present invention is directed to improving the seaming together of adjacent roof membranes against degradative environmental forces, particularly improving lap joint seals when the adjacent membranes are installed in overlapping relationship, the essence of the invention being providing adjacent membranes for the lap joint where opposed edges are tapered rather than being the conventional perpendicular cut of the roofing tapes heretofore employed.

When two or more membranes are laid down to cover the roof area, it is customary to seal adjacent membranes together in overlapping relationship (called a "lap joint") in order to get a good protective seal which moisture cannot penetrate. A particularly efficacious way of perfecting this seal, particularly with EPDM or similar elastomer membranes is by "sandwiching" a two-faced adhesive tape between the superposed (overlapping) edges of adjacent membranes.

The conventional roof membranes heretofore employed for this purpose have straight or perpendicular edges which it has been found provide a void in the lamination extending along the length (long dimension) of the lap joint. The imperfect lamination in time permits the random occurrence of fish-mouth (resulting from Poisson's effect), which is seen visually as a "puckered" separation or delamination which can be likened to a fish mouth.

When employing tapered membranes in the lap joint in accordance with the present invention, the occurrence of this phenomenon is materially inhibited if not totally obviated during the projected life of the roofing system.

The present invention will be best understood by reference to the accompanying drawings.

Figure 1:
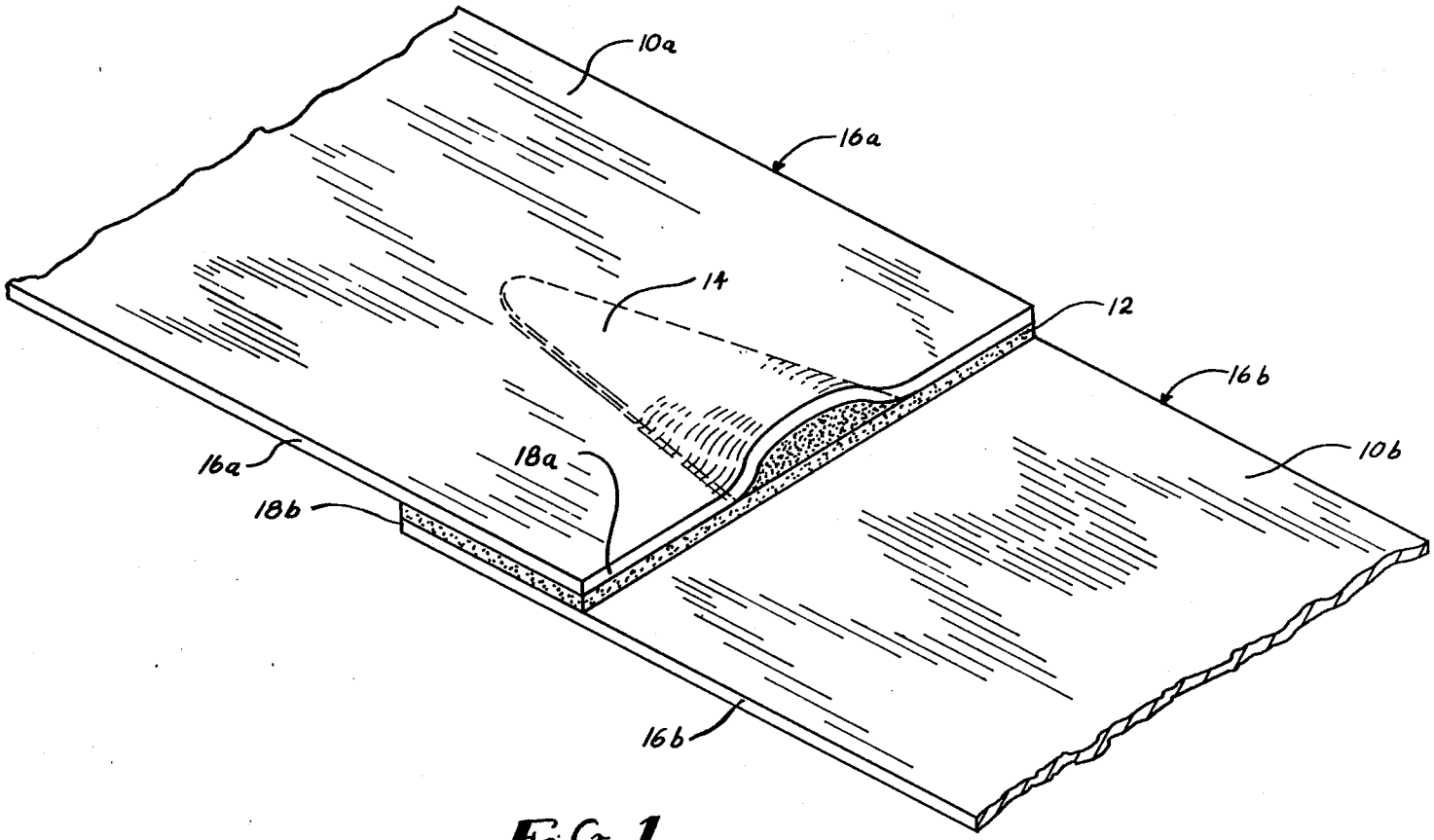
FIG. 1 is a fragemented perspective view showing the effect of environmental forces on the lap joint of two roof membranes of the prior art.

FIG. 1 illustrates a lap joint of the prior art between two membranes 10*a* and 10*b*. As shown, membrane 10a has lateral edges 16*a* and an end 18*a;* while membrane 10b has corresponding edges 16*b* and an end 18*b*. The respective ends are shown to be secured in overlapping relationship by adhesive layer 12 to provide a lap joint in the end-to-end positioning whose dimensions are defined by the width of the respective membranes and the distance between the overlapping ends, 18*a* and 18*b*.

The lower adherend 10*b* will deform laterally in time under the influence of Poisson's effect, whereas the upper adherend is not under this effect. Consequently, since they are bonded together, the end portion of the upper adherend wants to move with the lower adherend. However, the only way the upper adherend can move is to fold, resulting in a plurality of random "puckered" separations along the lap joint seam which are defined, because of their appearance (and the relationship to Poisson) as "fish-mouth". One such separation 14 is shown in the drawing.

Figure 2:
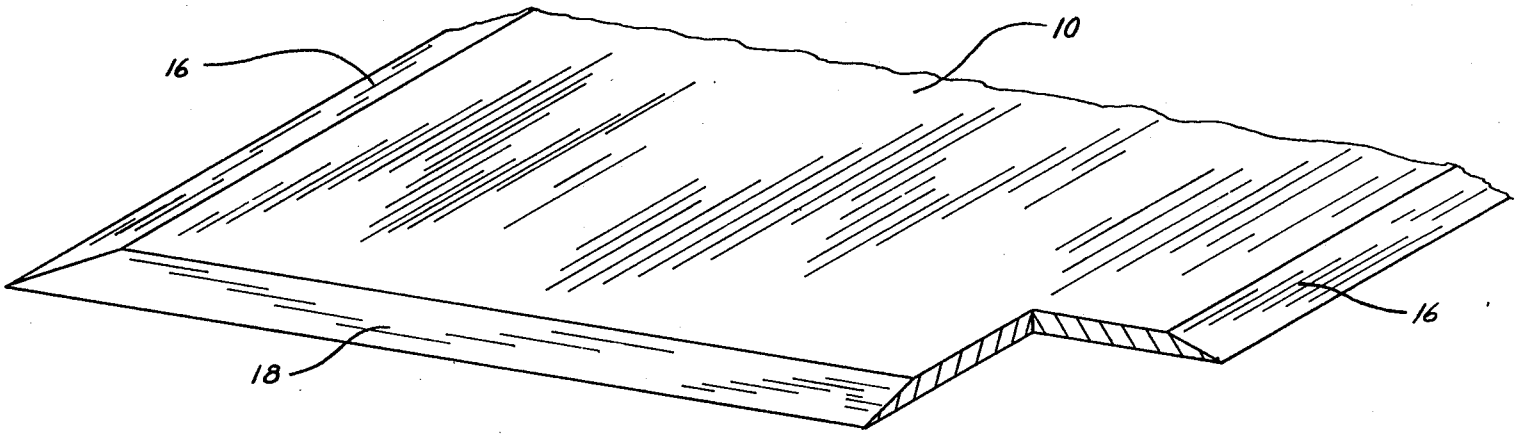
FIG. 2 is a fragmented perspective view the novel membrane of this invention with a portion cut away.

In accordance with the present invention, the fish-mouth problem is greatly inhibited if not precluded entirely by the tapered membrane structure as shown in FIG. 2. As shown therein, membrane 10 has tapered lateral edges 16 and ends 18, only one of which ends is shown in the fragmented view. It will of course be understood theroetically only the edge or end portion forming the lap joint need by tapered. However, for versatility in use, all peripheral portions are preferably tapered, as shown in the drawing.

Figure 3:
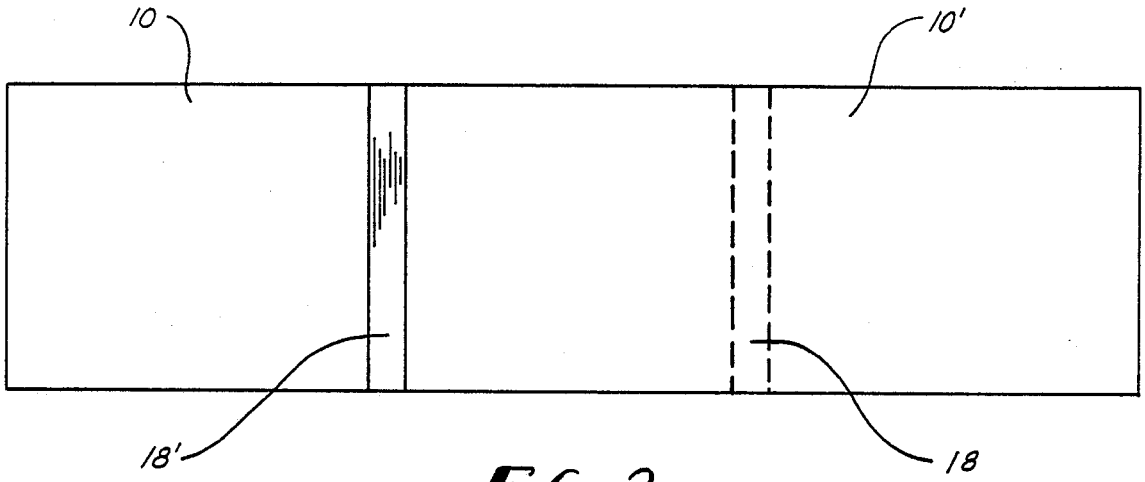
FIG. 3 is a top plan view of a lap joint made with two membranes as shown in FIG. 2.
Figure 4:
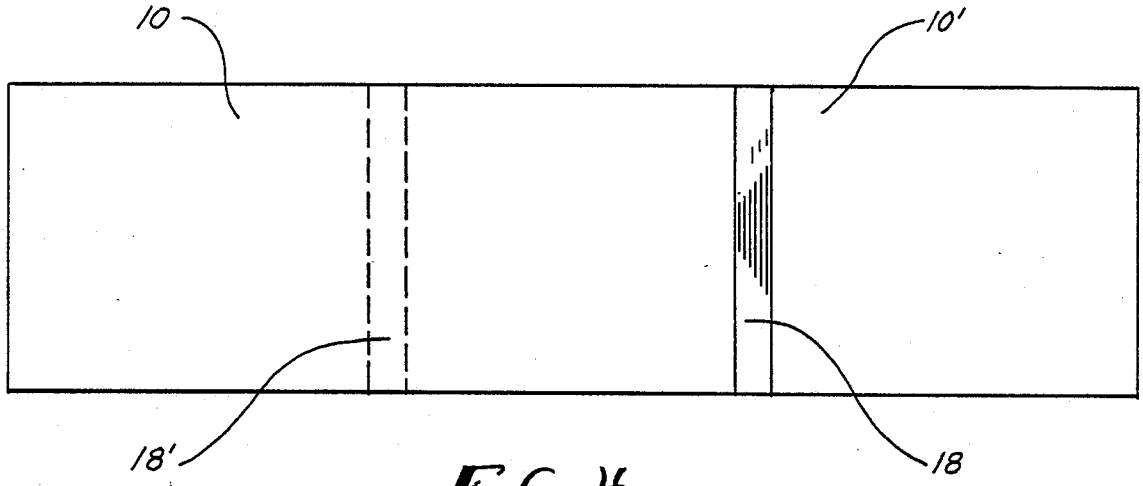
FIG. 4 is a bottom plan view of the lap joint of FIG. 3.
Figure 5:
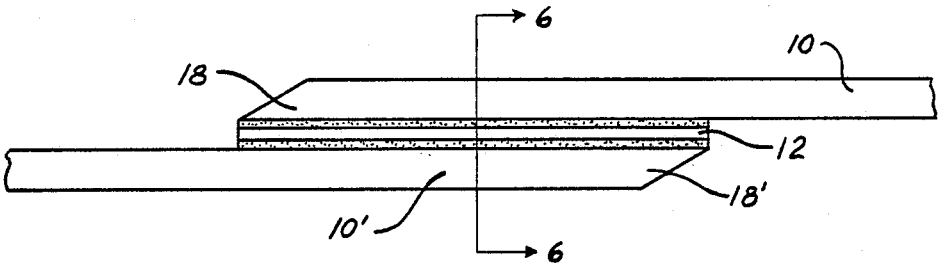
FIG. 5 is a side elevational view of the lap joint of FIG. 3 and 4.
Figure 6:
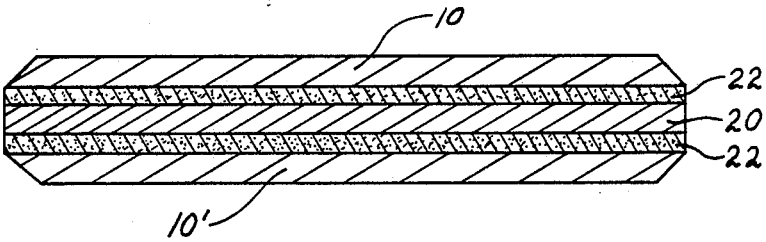
FIG. 6 is a sectional view taken along laiens 6—6 in FIG. 5.

FIGS. 3 and 4 are top and bottom plan views, showing two similar membranes of this invention, i.e. membranes as illustrated in FIG. 2, designated as 10 and $10^1$ with their ends 18 and $18^1$, overlapping to form the lap joint. With reference to FIGS. 5–6, the lap joint is provided by two faced-adhesive 12 consisting of sheet material 20 coated on either side with suitable adhesive layer 22, e.g. a rubber-based pressure sensitive adhesive.

The adhesive which may be employed in the lap joints may be of per se known composition and dimensions. As examples of adhesives which are typically employed, mention may be made of rubber-based adhesives, acrylic adhesives, mastic compounds and the like. Of particular interest in the practice of this invention are the rubber-based adhesives which, are previoulsy mentioned, are most useful in providing lap joints with EPDM membranes.

Preferably, use is made of two-faced pressure sensitive adhesive tape which may vary in thickness and will typically be on the order of at least twenty mils thick. The width of the tape may also vary, and will generally be at least two inches.

Although the two-faced tape may be provided by coating an adhesive layer of desired thickness on both sides of a polyolefin or other suitable backing sheet, if the adhesive possesses the requisite dimensional stability, the backing sheet can be eliminated so that the tape is in the form of a monolayer of adhesive. It will of course be appreciated that in packaging, means should be provided to prevent sticking of the adhesive to itself or to any other adherend prior to use. The most efficacious way to do this is to package the tape in roll form with a release sheet engaging one surface thereof so that on unwinding, both adhesive surfaces can be protected by the release sheet.

The degree of taper which may be employed may vary. At least some beneficial results may be obtained with an angle of the taper as great as 40° to the horizontal. However, for optimum results, the degree of taper should be no greater than 30°. As will be appreciated, the minimum angle of taper is in part dependent upon the thickness of the tape. That is to say, the smallest degree of taper reasonably obtainable is directly proportional to the thickness of the tape. While this thickness, may for example vary from on the order of 5 mils to on the order of 120 mils, it would be extremely difficult if not impossible to provide a relatively small angle of taper on say, a 5 mil tape. Conversely, this would be quite easy on, say, a 120 mil thick tape. Consequently, it is not possible to state quantitatively the smallest degree of taper without stating the thickness of the tape. It can be however, be stated as a general proposition that for optimum results, the degree of taper to be employed would generally be in excess of about 10 to the horizontal. To achieve this taper, at least with conventional production equipment, tape 10 should preferably have a thickness of at least 25 mils.

the method of providing the taper is not critical. It may, for example, be provided by conventional slitting devices having a pair of knives with adjustable angle positioned on a rotatable shaft at the desired angle, as described in detail in the aforementioned parent application, Ser. No. 867,110, filed May 23, 1986, relating to tapered tapes for wrapping metal objects, particularly those intended for inground implantation. As described therein and shown in the accompanying illustrative drawings, a web of tape may be advanced beneath the knives onto a rotating roller provided with a series of spaced grooves. Each knife is positioned over one of these grooves preselected according to the desired width for the tape. Following the cutting or slitting operation, the cut portions of the web are advanced to a roll-up operation.

In the following illustrative examples demonstrating the improvements obtainable in accordance with the present invention pieces of membranes ("coupons") were used for purposes of ease of handling and testing and analysis in the laboratory.

EXAMPLE 1

Samples of a 45 mil EPDM roofing membrane coupons about 3 inches in width and about 5 inches in length were bonded with a conventional 40 mil two-faced rubber-based lap seam adhesive tape to provide a lap joint (overlap) of about 2.57 inches. In one set of samples (test), the opposed leading and trailing edges, respectively, of the two membrane coupons for the lap seam were tapered at an angle of 30 degrees (as previously described and shown in the drawing.) A similar set of samples was prepared (control), except that the edges of the coupon membranes were conventional perpendicular cut. One set of the samples was aged at room temperature for one week; and a second set was subjected to accelerated aging at 160° F. for one week. The results for the room temperature experiments revealed improvements as high as 41% in ultimate load time and 44% in "fish mouth" for the tapered (test) lap joint; and 13% in ultimate load time and 28% in "fish mouth" for the accelerated aging experiment.

EXAMPLE 2

In order to assess the effect of taper on overlap displacements, samples similar to the ones described in the preceding example were used, except the overlap length was reduced to ⅜ inch. This was done in order to increase the magnitude of cleavage stresses and to obtain more noticeable results. Four samples prepared in this fashion were tested. The test results indicated that the extent of adherend separation in the longitudinal direction was reduced with the tapered lap joint tape by about 45% and the out-of-plane adherend separation (in the direction normal to the overlap) was reduced 47%.

From the foregoing test results it will thus be observed that with a given load-bearing, "fish-mouth" or separation in the lap joint which will inherently result with perpendicular cut membranes can be elimianted by use of the tapered membranes of this invention. Alternatively or stated another way, with the tapered tape, the load-bearing capacity of the lap joint can be materially increased before meaningful separation can occur.

By way of recapitulation, from the foregoing description and illustrative examples, it will be seen that the present invention employing tapered roof membranes in lieu of the conventional perpendicular cut ones will provide very significant improvements in load-bearing capacity and/or resistance to separation of the lap joint seam. While, for purposes of illustration reference has been made to EPDM roof membranes and to the two-faced pressure sensitive adhesive tapes for seaming the lap joint, it is to be expressly understood that the invention is not restricted thereto. Since the present invention may be regarded as a modification or improvement in the physical structure of the membranes, it will be appreciated that the chemistry, i.e. the chemical composition of the membrane and/or seaming adhesive is not material. Irrespective of the chemical nature of the membranes, the material employed to seam them together and the manner of installation, the tapered membranes will provide significant stability of the lap joint against the degradative environmental forces.

In order to define unequivocally the relationship of the adjacent membranes in the lap joint in accordance with this invention, i.e. which sides of the tapered membranes are in opposed (superposed) relationship, it is appropriate to define the taper as used herein and in the appended claims. If one visualizes a sheet material having two opposed sides or major surfaces, the taper may be defined as cutting the peripheral edge(s) at an angle from the first major surface to the opposite surface so that the first major surface has smaller surface area provided by the angle of the taper.

In preparing the lap joint, the first major surfaces having the smaller surface area will provide the outer surfaces of the lap joint with the respective major surfaces of greater surface area being superposition.

Since certain changes may be made without departing from the scope of the invention herein described, it is intended that all matter contained in the foregoing description, including the examples, shall be taken as illustrative and not in a limiting sense.

I claim:

1. In a roofing system for protecting the surface of a roof, said system comprising at least two adjacent roof membranes covering said roof surface, each said membrane having top and bottom parallel planar surfaces, a portion of the bottom planar surface of one said adjacent membrane overlapping a portion of the top planar surface of the other said adjacent membrane, said lapping portions being seamed together by adhesive means to form a lap joint, the improvement wherein the facing edges of the lapping portions of said membranes are tapered so that one planar surface of each said membrane is smaller than the other planar surface of said membrane, said membranes being positioned on said roof surface so that the smaller planar surface areas of said membranes form the outer surfaces of said lap joint, the planar surfaces of said membranes having the greater surface area being adhered together by said adhesive means.

2. A roofing system as defined in claim 1 wherein the angle of taper on said opposed edge of each said membrane is no greater than about 40° to the horizontal.

3. A roofing system as defined in claim 1 wherein the angle of taper on said opposed edge of each said membrane is no greater than about 30° to the horizontal.

4. A roofing system as defined in claim 1 wherein the angle of taper on said opposed edge of each said membrane is substantially the same.

5. A roofing system as defined in claim 1 wherein said adhesive means forming said lap joint seam comprises a two-faced adhesive tape.

6. A roofing system as defined in claim 5 wherein said adhesive tape comprises a rubber-based pressure sensitive adhesive.

7. A roofing system as defined in claim 6 wherein said rubber-based adhesive comprises a butyl rubber.

8. A roofing system as defined in claim 1 wherein each said membrane comprises an elastomer.

9. A roofing system as defined in claim 8 wherein said elastomer comprises ethylene propylene diene monomer.

10. A roofing system as defined in claim 1 wherein each of said membranes is substantially rectangular in configuration and all four edges of each membrane are tapered, the angle of each said taper being substantially the same.

* * * * *